US011142906B2

(12) United States Patent
Stafford

(10) Patent No.: US 11,142,906 B2
(45) Date of Patent: Oct. 12, 2021

(54) SEMI-PERMANENT RELOCATABLE STRUCTURE SYSTEM

(71) Applicant: Creative Tent International, LLC, Henderson, NV (US)

(72) Inventor: Robert Stafford, Henderson, NV (US)

(73) Assignee: CREATIVE TENT INTERNATIONAL, LLC, Henderson, NV (US)

( * ) Notice: Subject to any disclaimer, the term of this patent is extended or adjusted under 35 U.S.C. 154(b) by 0 days.

(21) Appl. No.: 16/460,014

(22) Filed: Jul. 2, 2019

(65) Prior Publication Data

US 2020/0011054 A1 Jan. 9, 2020

Related U.S. Application Data

(60) Provisional application No. 62/694,767, filed on Jul. 6, 2018.

(51) Int. Cl.

| | |
|---|---|
| ***E04B 7/16*** | (2006.01) |
| ***E04B 1/343*** | (2006.01) |
| *E04H 15/00* | (2006.01) |

(52) U.S. Cl.

CPC ..... *E04B 7/16* (2013.01); *E04B 1/343* (2013.01); *E04H 15/008* (2013.01)

(58) Field of Classification Search

CPC ... E04B 7/16; E04B 1/343; E04C 3/40; E04H 15/008

USPC ..... 52/64

See application file for complete search history.

(56) References Cited

U.S. PATENT DOCUMENTS

| | | | | | |
|---|---|---|---|---|---|
| 3,424,178 | A * | 1/1969 | Yoshimi | E04H 15/44 | 135/157 |
| 3,760,550 | A * | 9/1973 | Mueller | E04C 3/005 | 52/641 |
| 3,869,836 | A * | 3/1975 | Allen | E04B 1/34336 | 52/23 |
| 4,118,904 | A * | 10/1978 | Sprung | E04H 15/18 | 135/119 |
| 4,175,361 | A * | 11/1979 | Kumode | E04B 1/34305 | 52/66 |
| 4,280,306 | A * | 7/1981 | Milinic | E04H 15/18 | 52/63 |
| 4,467,573 | A * | 8/1984 | Langerbeck | E04H 5/02 | 52/79.5 |
| 4,641,477 | A * | 2/1987 | Schleck | E04B 1/18 | 52/646 |

(Continued)

FOREIGN PATENT DOCUMENTS

| | | | | |
|---|---|---|---|---|
| DE | 4026984 A1 * | 2/1992 | ..... | E04B 7/166 |
| DE | 102004010778 A1 * | 9/2005 | ..... | E04B 1/19 |

(Continued)

*Primary Examiner* — Patrick J Maestri
*Assistant Examiner* — Joseph J. Sadlon
(74) *Attorney, Agent, or Firm* — Knobbe Martens Olson & Bear LLP

(57) ABSTRACT

A semi-permanent relocatable structure system can be used to construct structures of various sizes and configurations from various components. The components can include leg beams, eave beams, straight roof beams, and apex beams. The width of the structure can be adjusted by interchanging the straight roof beams. The structure can further be customized and adapted over time with various units so as to meet changing needs of the user.

5 Claims, 15 Drawing Sheets

(56) References Cited

U.S. PATENT DOCUMENTS 4,769,962 A * 9/1988 Pohl ..... E04B 1/34326 135/160
4,841,688 A * 6/1989 Rinaldi ..... E04H 15/322 52/63
5,283,993 A * 2/1994 Sprung, Sr. ..... E04H 15/38 135/117
5,331,777 A * 7/1994 Chi-Yuan ..... A63B 71/022 135/128
5,526,614 A * 6/1996 Huang ..... E04C 3/09
5,544,622 A * 8/1996 Weelink ..... A01K 1/0058 119/436
5,596,843 A * 1/1997 Watson ..... A01G 9/1415 52/71
5,598,668 A * 2/1997 Isom ..... A01G 9/16 52/86
5,634,638 A * 6/1997 Havens ..... A63B 71/022 135/128
5,881,515 A * 3/1999 George ..... E04B 1/34326 52/233
5,964,065 A * 10/1999 Migurski ..... E04H 3/08 52/64
6,014,948 A * 1/2000 Gordon ..... A01K 1/00 119/449
6,185,877 B1 * 2/2001 Lloyd ..... A01G 9/16 52/64
6,668,496 B1 * 12/2003 Clapp ..... B60P 3/32 52/745.02
7,600,348 B1 * 10/2009 Kostka ..... E04H 3/08 52/64
7,765,748 B2 * 8/2010 Hawes ..... E04G 21/24 52/102
7,814,723 B2 * 10/2010 VanElverdinghe ..... E04C 3/40 52/641
7,849,639 B2 * 12/2010 Sprung ..... E04H 15/18 52/82
7,980,029 B2 * 7/2011 Ahmedy ..... E04H 3/165 52/71
8,671,642 B2 * 3/2014 Green ..... E04C 3/42 52/643
8,701,356 B2 * 4/2014 Forsland ..... E04B 1/19 52/66
8,701,689 B2 * 4/2014 Warner ..... E04B 1/342 135/121
9,038,349 B2 * 5/2015 Fox ..... E04H 15/322 52/712
9,163,394 B1 * 10/2015 Barker ..... E04B 1/34384
9,273,458 B2 * 3/2016 Davis ..... E04C 3/09
9,303,426 B2 * 4/2016 Workman ..... E04H 15/56
9,388,564 B2 * 7/2016 Ros Garcia ..... E04B 1/3205
9,611,637 B2 * 4/2017 Dynon ..... E04B 1/3444
10,167,644 B1 * 1/2019 Aliev ..... E04H 3/08 52/64
10,508,005 B2 * 12/2019 Spronken ..... A45B 11/00
10,697,193 B2 * 6/2020 Tafuro ..... E04B 1/34336
2018/0352921 A1 * 12/2018 Arndt ..... A45B 11/00

FOREIGN PATENT DOCUMENTS

DE 202006002629 U1 * 5/2006 ..... E04H 15/28
EP 2835474 A1 * 2/2015 ..... E04H 15/008
FR 972573 A * 1/1951 ..... E04H 15/008
FR 3034801 A1 * 10/2016 ..... E04H 3/165

* cited by examiner

SEMI-PERMANENT RELOCATABLE STRUCTURE SYSTEM

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

This application relates to semi-permanent relocatable structures.

Description

Semi-permanent relocatable structures are used in a wide variety of applications. For example, over the past few decades the US military has relied upon relocatable structures for rapid deployment for use as aircraft hangars, vehicle maintenance facilities, storage/warehousing, and camp solutions both at home and abroad. Semi-permanent relocatable structures can also have civilian applications.

BRIEF DESCRIPTION OF THE DRAWINGS

The features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings.

FIG. 2A illustrates an embodiment of a curve beam.

FIG. 2B illustrates an embodiment of an apex beam configured for use at a gable end or center arch.

FIG. 2C illustrates an embodiment an apex beam configured for use at a full width door end arch.

FIG. 2D illustrates an embodiment of an apex beam configured for use at a full width door bottom arch.

FIG. 2E illustrates an embodiment of an eave beam configured for use at either a gable end or center arch.

FIG. 2F illustrates an embodiment of an eave beam configured for use at a full width door end arch.

FIG. 3A illustrates an embodiment of a leg beam.

FIG. 3B illustrates an embodiment of a leg beam configured for use at a gable end or center arch.

FIG. 3C illustrates an embodiment of a leg beam configured for use at an end arch.

FIG. 3D illustrates an embodiment of a leg beam configured for use with a full width door.

FIG. 4A illustrates an embodiment of a roof straight beam.

FIG. 4B illustrates an embodiment of a roof straight beam configured for use at a center arch.

FIG. 4C illustrates an embodiment of a roof straight beam configured for use at a gable end.

FIG. 4D illustrates an embodiment of a roof straight beam configured for use with a full width door.

FIG. 7A illustrates an example of a full width door unit.

FIG. 7B illustrates an example of a gable end unit.

FIG. 7C illustrates an example of a fabric vertical door unit.

FIG. 7D illustrates an example of a bay end unit.

DETAILED DESCRIPTION

Figure 1:
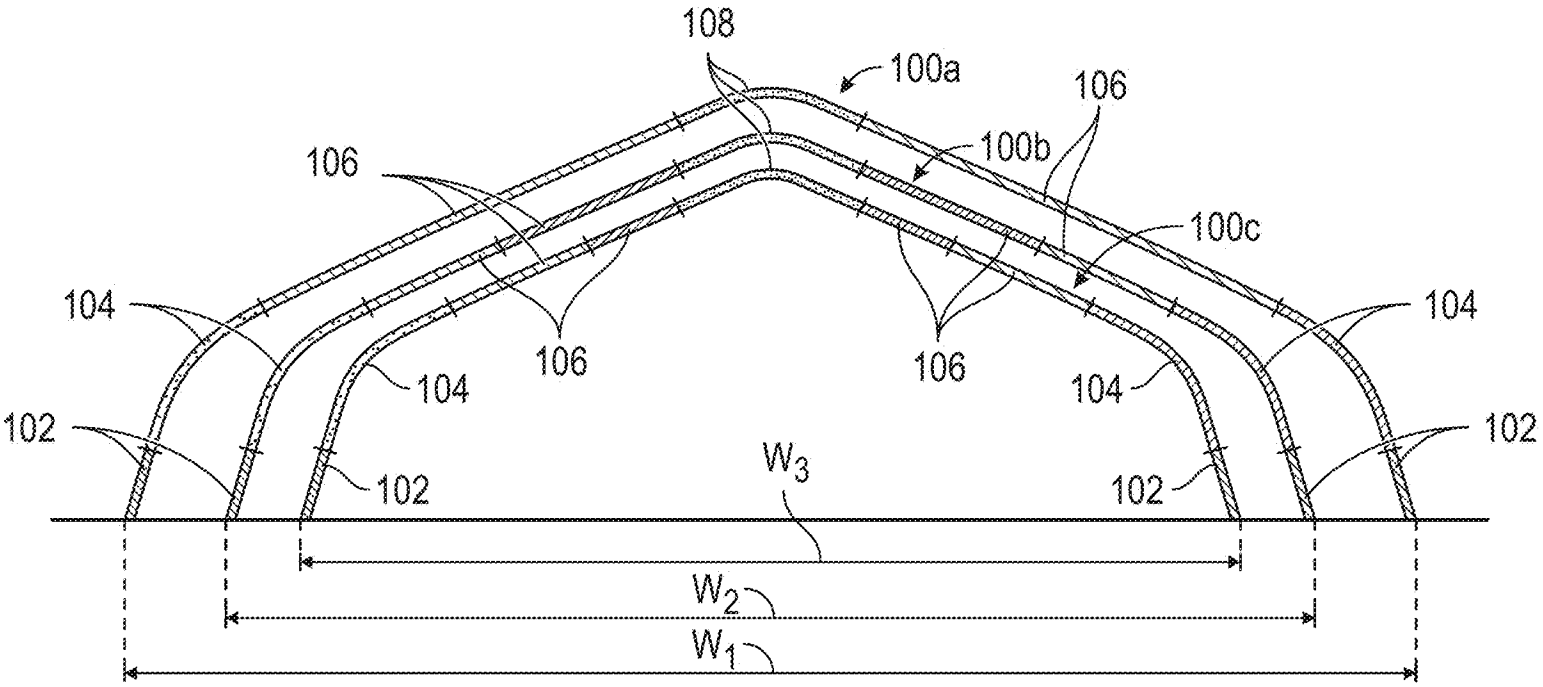
FIG. 1 illustrates three example arches of a semi-permanent relocatable structure constructed from components of a semi-permanent relocatable structure system according to one embodiment.

Semi-permanent relocatable structures can be configured for large-scale and/or long term use, while remaining relatively easy to set up and or take down compared to traditional permanent structures. Semi-permanent relocatable structures can provide, for example, structural stability and longevity, similar to permanent structures, while being easy to assemble and portable, like portable structures. Semi-permanent relocatable structures can be used in a variety of situations and environments. For example, semi-permanent relocatable structures can be used in military applications.

In some embodiments, semi-permanent relocatable structures comprise a rigid frame and a fabric covering. Several detailed embodiments of semi-permanent relocatable structures are described in U.S. patent application Ser. No. 13/349,480, filed Jan. 12, 2012, and entitled "Method of Erecting Portable Structure and Related Apparatus," which is incorporated herein by reference in its entirety and for all purposes. In some instances, semi-permanent relocatable structures are also referred to as engineered shelters or structures.

This application relates to a semi-permanent relocatable structure system that can be used to construct structures of various sizes and configurations from various components. The system embodies a unique design that integrates parts in various configurations allowing for exceptional versatility and efficiency. In some embodiments, the system, and the structures that can be constructed therefrom, are characterized by their strength and durability, ease of installation, movability, weather resistance, and quick deployment. As will be described in greater detail below, the system can be used to construct various structures of different sizes, for example, offering structures of 20 feet to 160 feet wide. Further, the structures can be constructed in a wide variety of lengths, for example, by combining any number of different 12 feet long bays.

In some embodiments, the system and the structures that can be constructed therefrom, are engineered to International Building Code (IBC 2012). In some embodiments, the structures can be fully relocatable and ground erectable. In some embodiments, the system, and structures are capable of seamlessly transitioning from temporary to permanent and across various applications to adapt to evolving needs. In some embodiments, the system utilizes high quality aluminum frame and coated PVC fabric for strength and durability, as well as integrated accessories, including solar power systems, for installation in even the most extreme environments. The system has been designed with a reduced load volume for compact transportation and storage, which allows the system to be used for rapid deployment anywhere in the world. As will be described in greater detail below, the system provides a dynamic, high quality and cost effective solution for semi-permanent relocatable structure.

Traditionally, relocatable semi-permanent shelters have been designed with fixed dimensions and configurations. For example, the US military has used relocatable semi-permanent shelters, referred to the military as Large Area Maintenance Shelters (LAMS) that are only available in fixed sizes of 75 feet by 192 or 75 feet by 128 feet. These structures were not adjustable, expandable, or reconfigurable, which prevented these structures from meeting constantly evolving requirements of size and functionality. Further, the complexity of today's ever-shifting geopolitical climate has generated the need for more dynamic shelter solutions in order to remain prepared, strong, and responsive to changing security threats.

The semi-permanent relocatable structure system described herein alleviates or resolves one or more of the above-noted disadvantages associated with traditional relocatable semi-permanent shelters. In particular, the semi-permanent relocatable structure system described herein allows construction of structures of various sizes and configurations from components. Further, the structures can be reconfigured and adapted, using the components, to change their size and functionality to suit a wide variety of situations, needs, and requirements.

As described in U.S. patent application Ser. No. 13/349,480, incorporated by reference herein, a semi-permanent relocatable structure can comprise a frame and a fabric covering. The frame may comprise a plurality of arches connected by purlins. In some embodiments, the arches extend across the width of the structure. In some embodiments, the arches span the entire width of the structure.

The semi-permanent relocatable structure system described herein includes a plurality of parts. In some embodiments, the parts can be used to construct the arches of the frame. The parts can be arranged in different configurations to construct structures of different sizes. Due to the extensive range of sizes that can be achieved using the system, the system can be used for a wide variety of applications including sunshades, billeting, command centers, maintenance centers, tactical vehicle covers, storage/warehousing, aircraft hangars, and BARE Base build up, among others.

FIG. 1 illustrates three example arches 100*a*, 100*b*, 100*c* (referred to generally as the arch 100) of different sizes for a semi-permanent relocatable structure constructed from components of a semi-permanent relocatable structure system according to one embodiment. As shown, the arch 100*a* comprises a first width W1, the arch 100*b*, comprises a second width W2, and the arch 100*c* comprises a third width W3. In the illustrated, example, W1 is longer than W2, and W2 is longer than W3. Examples lengths for the widths of the arches 100 will be described in greater detail below later in the application.

As noted previously, the arches 100 are constructed of various components. In the illustrated example, the components include leg beams 102, curved beams (including eave beams 104 and apex beams 108), and roof straight beams 106. As illustrated in FIG. 1, each of the arches 100*a*, 100*b*, 100*c* may use the same leg beams 102, eave beams 104, and apex beams 108. That is, the leg beams 102, eave beams 104, and apex beams 108 are useable with the different arches 100*a*, 100*b*, 100*c*.

The different widths W1, W2, W3 can be achieved by connecting different roof straight beams 106 with the leg beams 102, eave beams 104, and apex beams 108. For example, in the illustrated embodiment, the arch 100*a*, includes a single, longer roof straight beam 106, while the arch 100*b* includes two shorter roof straight beams 106. Further, in the illustrated embodiment, the arch 100*c* also includes two shorter roof straight beams 106, with one of the roof straight beams 106 being even shorter than the corresponding roof straight beam 106 of the arch 100*b*.

By providing a standard set of leg beams 102, eave beams 104, and apex beams 108 as well as a plurality of different roof straight beams 106 of different lengths, the system allow for construction of arches 100 of various different widths as shown in FIG. 1. Each of the leg beams 102, curved beams (including eave beams 104 and apex beams 108), and roof straight beams 106 can be configured to connect with the other beams in many different configurations. Importantly, in some embodiments, the beams allow for the width of a semi-permanent relocatable structure to be reconfigured as desired. Such beams allow structures to be modified by simply removing or adding different roof straight beams 106. In some embodiments, the leg beams 102, eave beams 104, and apex beams 108 remain constant while removing or adding different straight roof beams 106 transforms units to either expand or decrease width.

This system, including the beams described above can provide several advantages. For example, it can facilitate rapid and efficient conversion of a unit from one application to the next (e.g., by changing its size), provide ease in identification and inventory of parts, simplify packaging for reduced load volumes for compact transport and/or storage, and maintain consistency in the installation layout and construction process.

FIGS. 2A-4D provide detailed views of various embodiments of leg beams 102, curved beams (including eave beams 104 and apex beams 108), and roof straight beams 106. FIG. 2A-2F illustrates various embodiments of curved beams (eave beams 104 and apex beams 108) for arches 100 for semi-permanent relocatable structure constructed with a semi-permanent relocatable structure system. FIGS. 3A-3D illustrate various embodiments of leg beams 102 for arches 100 for semi-permanent relocatable structure constructed with a semi-permanent relocatable structure system. FIGS. 4A-4D illustrate various embodiments of roof straight beams 106 for arches 100 for semi-permanent relocatable structure constructed with a semi-permanent relocatable structure system. Each of these beams can be configured so as to be useable with the other beams to create semi-permanent relocatable structures of different sizes and configurations.

Figure 2A:
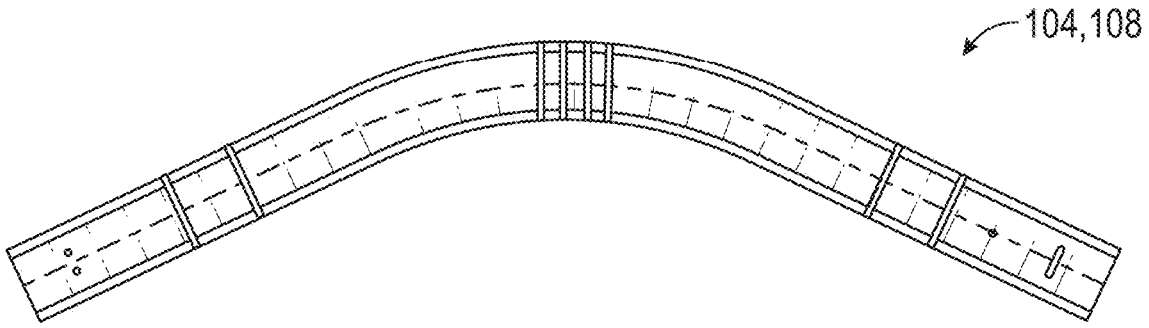
FIG. 2A-2F illustrates various embodiments of curved beams (eave and apex beams) for arches for semi-permanent relocatable structures constructed with a semi-permanent relocatable structure system.

FIG. 2A illustrates an embodiment of a curve beam (either an eave beam 104 or an apex beam 108). In some embodiments, the curve beam illustrated in FIG. 2A is configured to be used either as an eave beam 104 or an apex beam 108 of an arch 100 of a semi-permanent relocatable structure. As an eave beam 104, the curve beam is configured to connect to and be positioned between a leg beam 102 and a roof straight beam 106. As an apex beam 108, the curve beam is configured to connect to and be positioned between two roof straight beams 106 at the apex of the structure. The curve beam may be bent or formed at an angle that is suitable for use at either the eave or apex of the structure. In some embodiments, the angle is about 100 degrees, about 110 degrees, about 120 degrees, about 130 degrees, about 140 degrees, about 150 degrees or about 160 degrees. Other angles are also possible. Further, as illustrated in FIG. 2A, the curve beam (either an eave beam 104 or an apex beam 108) may include pre-drilled holes in various positions that allow the curve beam to be connected other beams or other components of the structure. The pre-drilled holes can be configured such that they are available for use regardless of where the curved beam is positioned on the structure (e.g., whether an eave beam 104 or an apex beam 108).

Figure 2B:
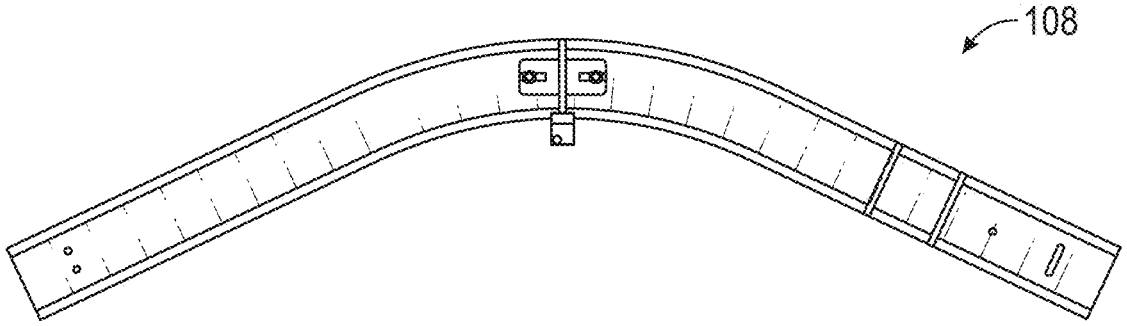

FIG. 2B illustrates an embodiment of an apex beam 108 configured for use at a gable end or center arch. As illustrated, the apex beam 108 can be bent or formed at angle as described above.

Figure 2C:
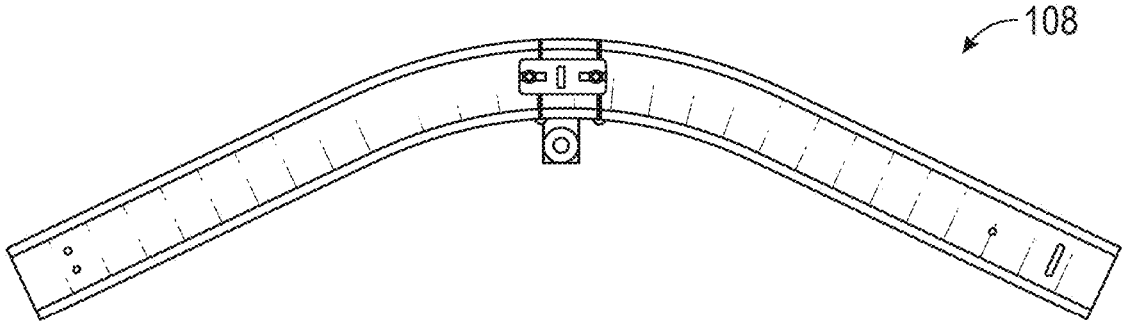

FIG. 2C illustrates an embodiment an apex beam 108 configured for use at a full width door end arch. In the illustrated embodiment, the apex beam 108 includes a winch cable pulley. The winch cable pulley can be positioned at the vertex of the angle of the apex beam 108. As illustrated, the apex beam 108 can be bent or formed at angle as described above.

Figure 2D:
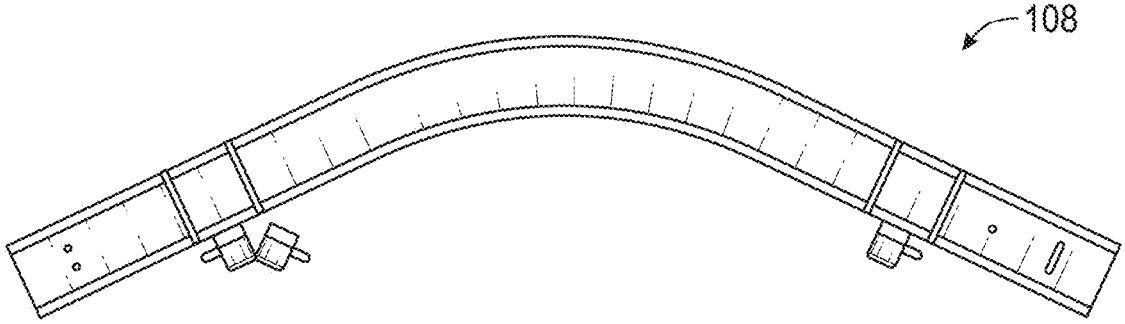

FIG. 2D illustrates an embodiment of an apex beam 108 configured for use at a full width door bottom arch. In the illustrated embodiment, the apex beam 108 includes two ratchet tie downs. The two tie downs can be positioned near the ends of the apex beam 108. In some embodiment, only a single tie down is included. As illustrated, the apex beam 108 can be bent or formed at angle as described above.

Figure 2E:
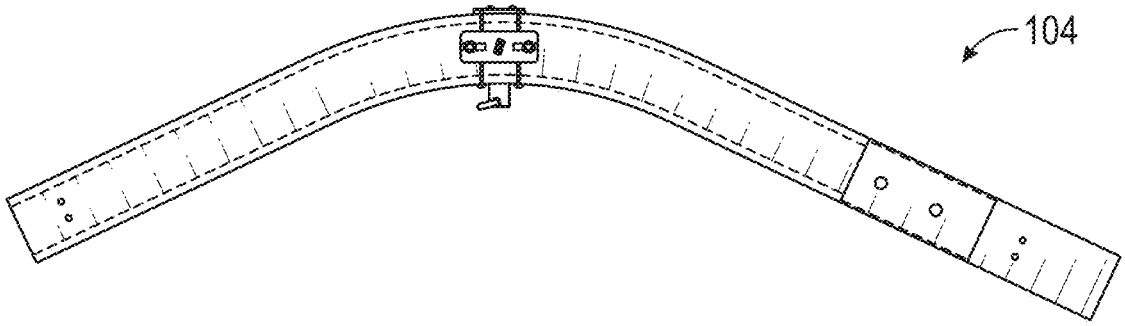

FIG. 2E illustrates an embodiment of an eave beam 104 configured for use at either a gable end or center arch. In the illustrated embodiment, the eave beam 104 includes a beam or arch insert on one end. The arch insert can be configured to allow the eave beam 104 to connect to a roof straight beam 106. In some embodiments, the arch insert can be configured to allow the eave beam 104 to connect to a leg beam 102. In some embodiments, arch inserts can be provided on both ends of the eave beam 104. The arch inserts can be configured to be received within corresponding structure on a leg beam 102 to connect the eave beam 104 the leg beam 102 to form an arch. As illustrated, the eave beam 104 can be bent or formed at angle as described above.

Figure 2F:
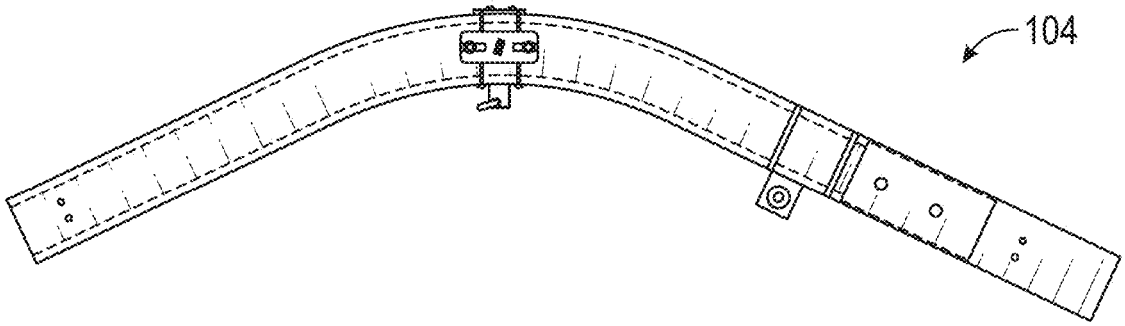

FIG. 2F illustrates an embodiment of an eave beam 104 configured for use at a full width door end arch. In the illustrated embodiment, the eave beam 104 includes a winch cable pulley. The winch cable pulley can be positioned near one end of the eave beam 104. As shown, the eave beam 104 can include one or more arch or beam inserts as described above. Further, as illustrated, the eave beam 104 can be bent or formed at an angle as described above.

Figure 3A:
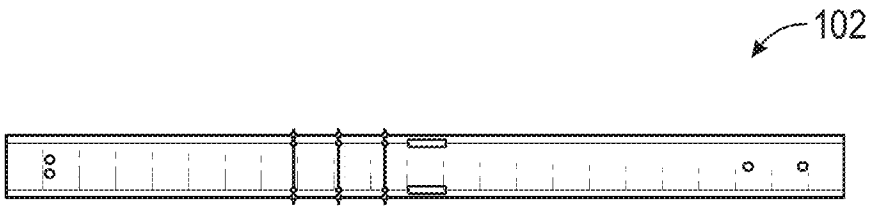
FIGS. 3A-3D illustrate various embodiments of leg beams for arches for semi-permanent relocatable structures constructed with a semi-permanent relocatable structure system.

FIG. 3A illustrates an embodiment of a leg beam 102. The leg beam 102 can be configured to connect to, for example, a base plate or other grounding structure on one end. In some embodiments, the leg beam 102 (and/or the structure generally) does not require foundations and can be installed on any surface (dirt, sand, grass, asphalt, and concrete). On an opposite end, the leg beam 102 can be configured to connect to an eave beam 104. For example, the leg beam 102 can include a structure configured to receive the arch or beam insert described above.

Figure 3B:
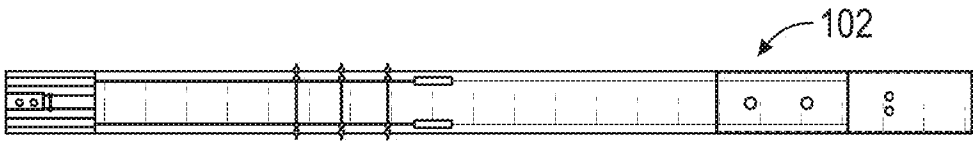

FIG. 3B illustrates an embodiment of a leg beam 102 configured for use at a gable end or center arch. As shown, in the illustrated embodiment, the leg beam 102 includes a base insert on one end and a beam or arch insert on the opposite end. The base insert may be configured for connecting the leg beam 102 to a base plate or other grounding structure.

Figure 3C:
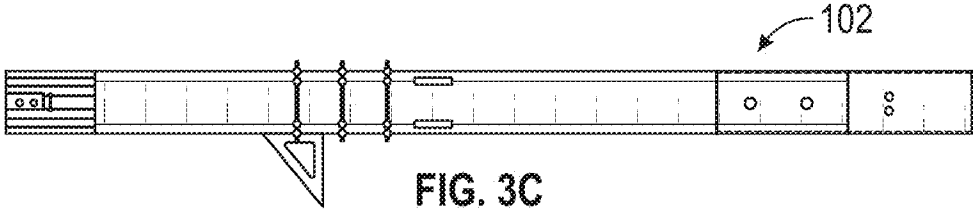

FIG. 3C illustrates an embodiment of a leg beam 102 configured for use at an end arch. In the illustrated embodiment, the leg beam 102 includes a bracket. The bracket can be bolted to the leg beam 102. The bracket can be configured to allow attachment of a winch or other structure or device.

Figure 3D:
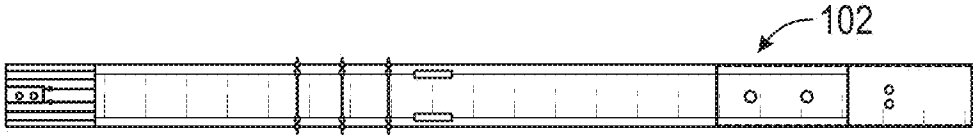

FIG. 3D illustrates an embodiment of a leg beam 102 configured for use with a full width door. The leg beams 102 of FIGS. 3A-3D can be provided in different lengths such that structures of different sizes can be assembled as desired by selecting different lengths of leg beams 102. For example, longer leg beams 102 can be used to create a taller structure, while shorter leg beams 102 can be used to create a shorter structure. Regardless of the length, the leg beams 102 can include standardized ends such that they can be connected to different base plates, apex beams, or eave beams.

Figure 4A:
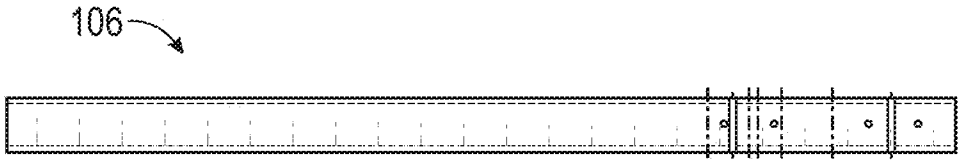
FIGS. 4A-4D illustrate various embodiments of roof straight beams for arches for semi-permanent relocatable structures constructed with a semi-permanent relocatable structure system.

FIG. 4A illustrates an embodiment of a roof straight beam 106. As noted above, the roof straight beam 106 can be provided in a plurality of lengths that can be used, either alone or in combination, to adjust the width of the arch 100. In some embodiments, an arch 100 includes (on each side of the apex) a single roof straight beam 106. In some embodiments, more than one roof straight beam 106, for example, two, three, four, or more, are used. As illustrated, the roof straight beam 106 may include pre-drilled holes in various positions that allow the roof straight beam 106 to be connected to other beams or other components of the structure. The pre-drilled holes can be configured such that they are available for use regardless of where the roof straight beam 106 is positioned on the structure.

Figure 4B:
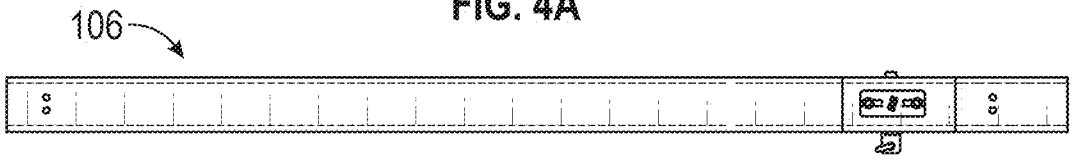

FIG. 4B illustrates an embodiment of a roof straight beam 106 configured for use at a center arch.

Figure 4C:
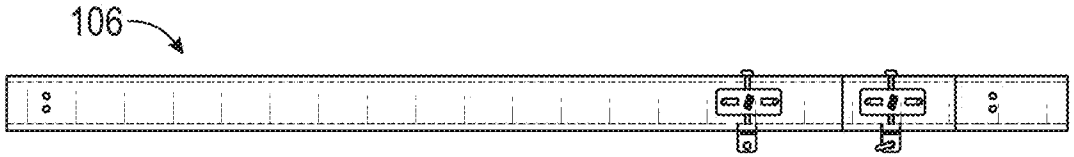

FIG. 4C illustrates an embodiment of a roof straight beam 106 configured for use at a gable end. The roof straight beam 106 can include features for attaching to a gable end module as will be described below.

Figure 4D:
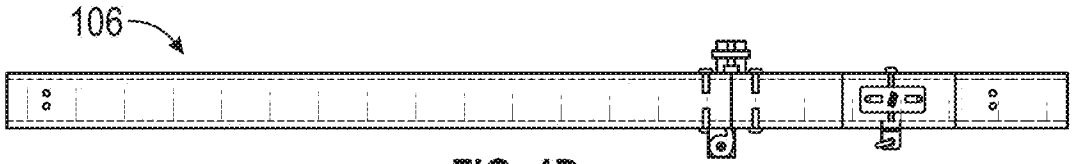

FIG. 4D illustrates an embodiment of a roof straight beam 106 configured for use with a full width door. The roof straight beam 106 can include features for attaching to a full width door module as will be described below.

The various leg beams 102, curved beams (including eave beams 104 and apex beams 108), and roof straight beams 106 described above can be provided in various lengths as desired. In some embodiments, the systems can be provided as a kit or collection of components generally configured to allow construction of structures of relatively similar sizes. Systems and kits of certain sizes are described by way of example below (FIGS. 5A-5E); however, it should be appreciated that other size systems and kits can be provided and that, in some embodiments, the components of any system or kit can be used with the components of any other system or kit because the components have been designed as described above.

Any dimensions shown in FIGS. 5A-5E are provided by way of example only.

Figure 5A:
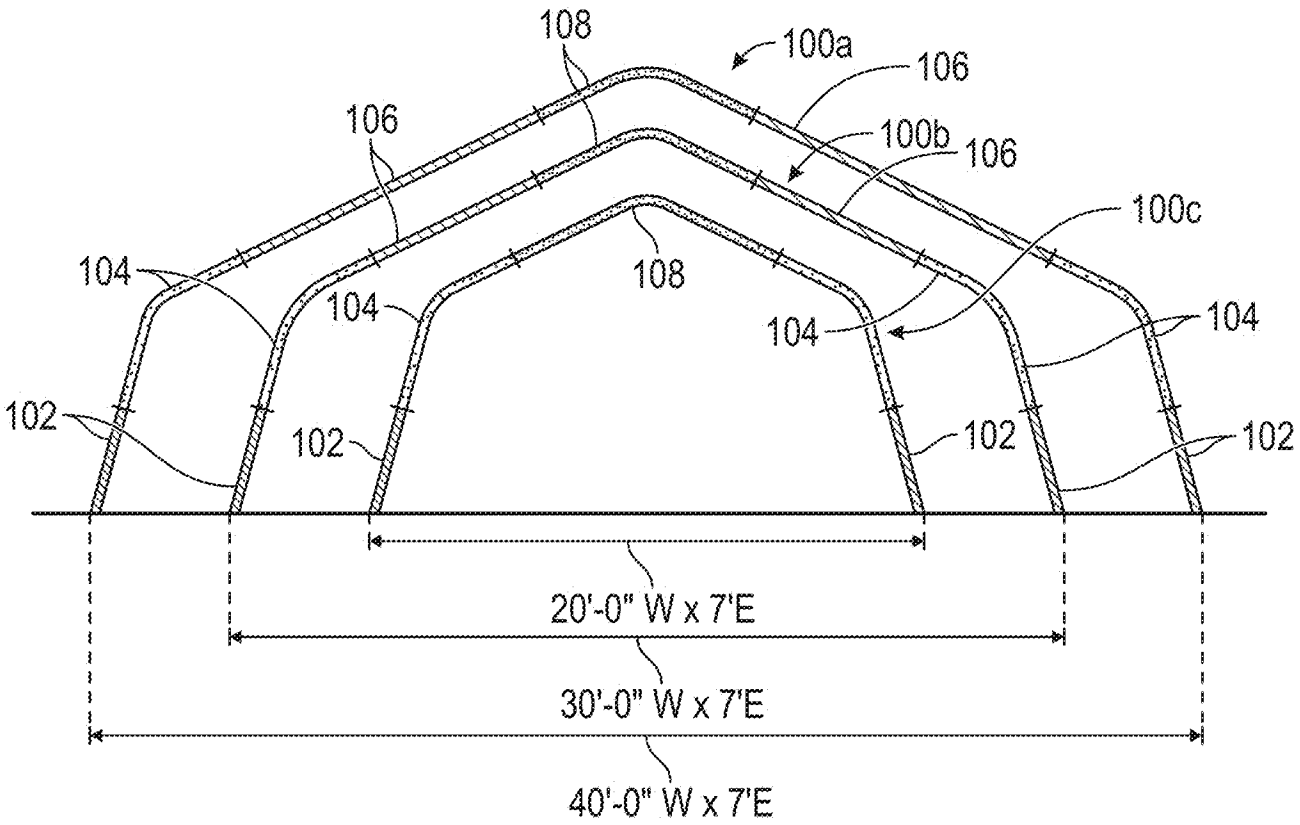
FIG. 5A illustrates three example arches of a semi-permanent relocatable structure constructed from components of a small semi-permanent relocatable structure system according to one embodiment.

FIG. 5A illustrates three example arches 100*a*, 100*b*, 100*c* of a semi-permanent relocatable structure constructed from components of a small semi-permanent relocatable structure system according to one embodiment. As before, the leg beams 102, eave beams 104, and apex beam 108 can all be the same for all arches 100*a*, 100*b*, 100*c*. The arch 100*a* includes a longer roof straight beam 106. As illustrated, the arch 100*b* includes a shorter roof straight beam 106. As illustrated, the arch 100*c* does not include a roof straight beam 106, and the eave beams 104 connect directly the apex beam. As illustrated, the small system can be configured to provide arches (and structures) with widths of 20 feet, 30 feet, or 40 feet. Further, in some embodiments, the structure is configured to be 7 feet tall at the eaves (in the illustrated embodiment). Other heights can also be possible.

Figure 5B:
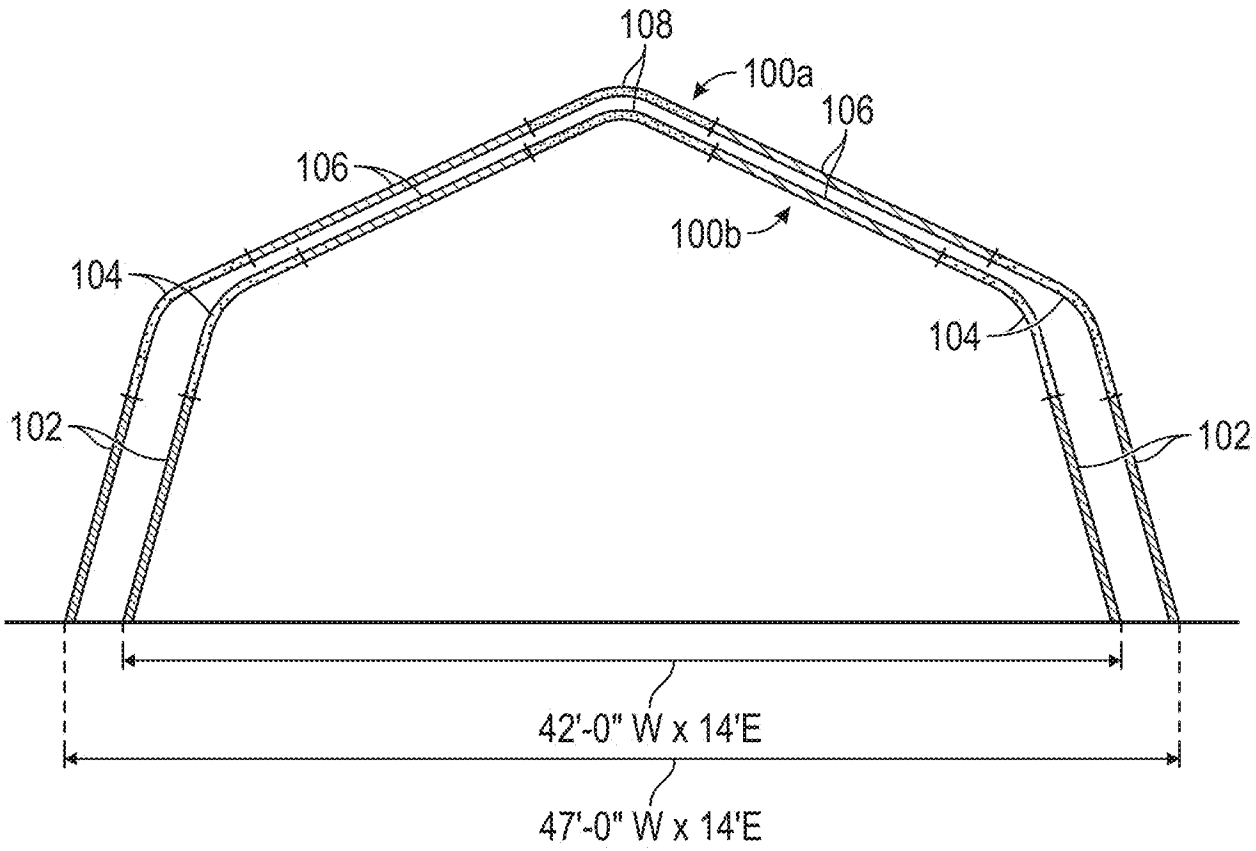
FIG. 5B illustrates two example arches of a semi-permanent relocatable structure constructed from components of a medium relocatable structure system according to one embodiment.

FIG. 5B illustrates two example arches 100*a*, 100*b* of a semi-permanent relocatable structure constructed from components of a medium semi-permanent relocatable structure system according to one embodiment. As before, the leg beams 102, eave beams 104, and apex beam 108 are the same for all arches 100*a*, 100*b*. The leg beams 102, eave beams 106, and apex beam 108 in FIG. 5B may be the same as those shown in FIGS. 5A and 5C-5E. The arch 100*a* includes a longer roof straight beam 106. The arch 100*b* includes a shorter roof straight beam 106. As illustrated, the medium system can be configured to provide arches 100 (and structures) with widths of 42 feet or 47 feet. In another embodiment, the medium system can provide a structure with a width of 32 feet. Further, the structure is configured to be 14 feet tall at the eaves (in the illustrated embodiment).

Figure 5C:
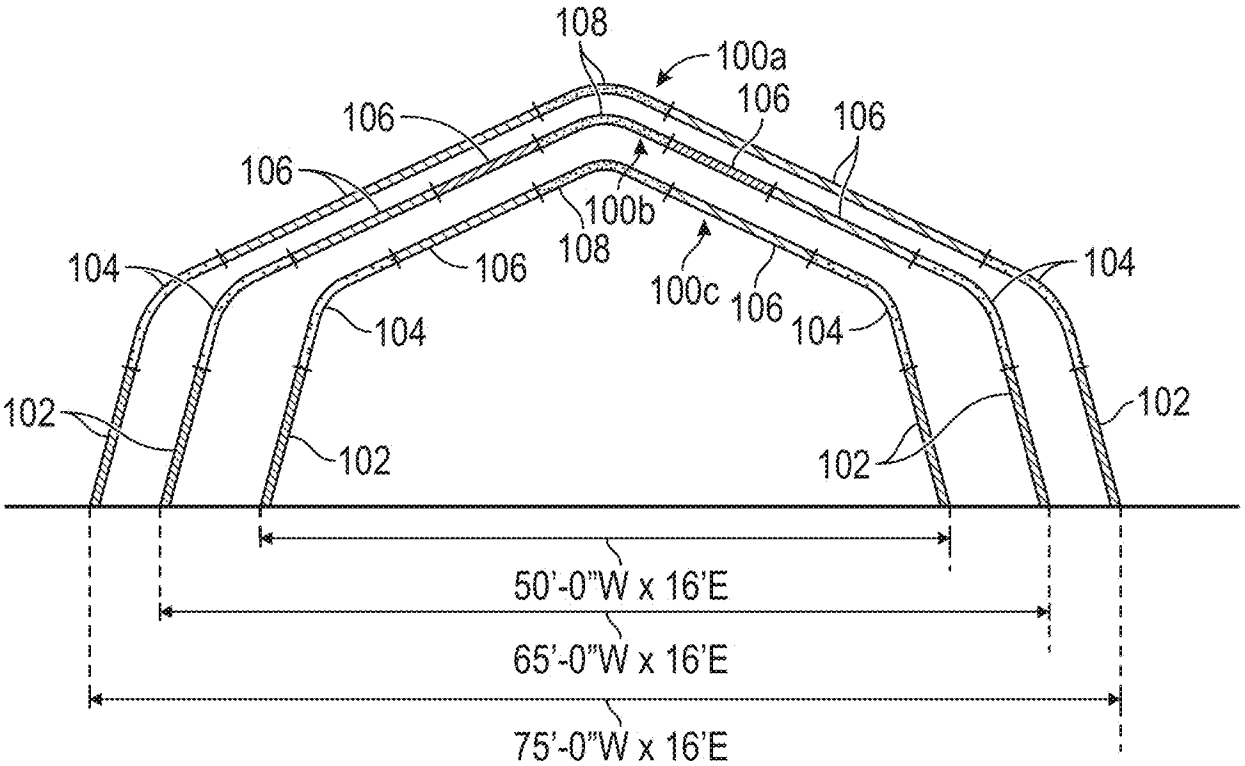
FIG. 5C illustrates three example arches of a semi-permanent relocatable structure constructed from components of a large relocatable structure system according to one embodiment.

FIG. 5C illustrates three example arches of a semi-permanent relocatable structure constructed from components of a large semi-permanent relocatable structure system according to one embodiment. The arch 100*a* includes a longer roof straight beam 106. The arch 100*b* includes two shorter roof straight beams 106. The arch 100*c* includes two even shorter straight roof beams 106. As illustrated, the large system can be configured to provide arches (and structures) with widths of 50 feet, 65 feet, or 75 feet. Further, the structure is configured to be 16 feet tall at the eaves (in the illustrated embodiment).

Figure 5D:
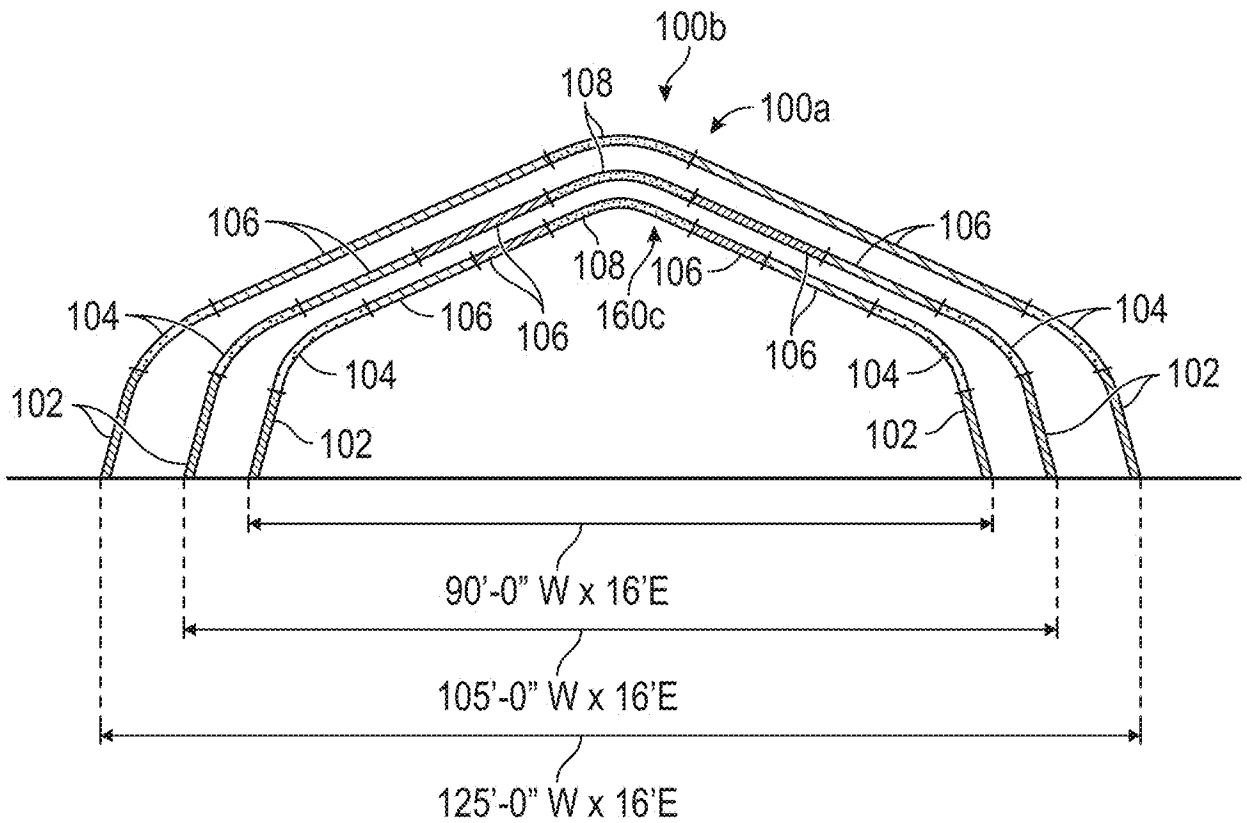
FIG. 5D illustrates three example arches of a semi-permanent relocatable structure constructed from components of an extra-large semi-permanent relocatable structure system according to one embodiment.

FIG. 5D illustrates three example arches of a semi-permanent relocatable structure constructed from components of an extra-large semi-permanent relocatable structure system according to one embodiment. The arch 100*a* includes a longer roof straight beam 106. The arch 100*b* includes two shorter roof straight beams 106. The arch 100*c* includes two even shorter straight roof beams 106. As illustrated, the extra-large system can be configured to provide arches (and structures) with widths of 90 feet, 105 feet, or 125 feet. Further, the structure is configured to be 16 feet tall at the eaves (in the illustrated embodiment).

Figure 5E:
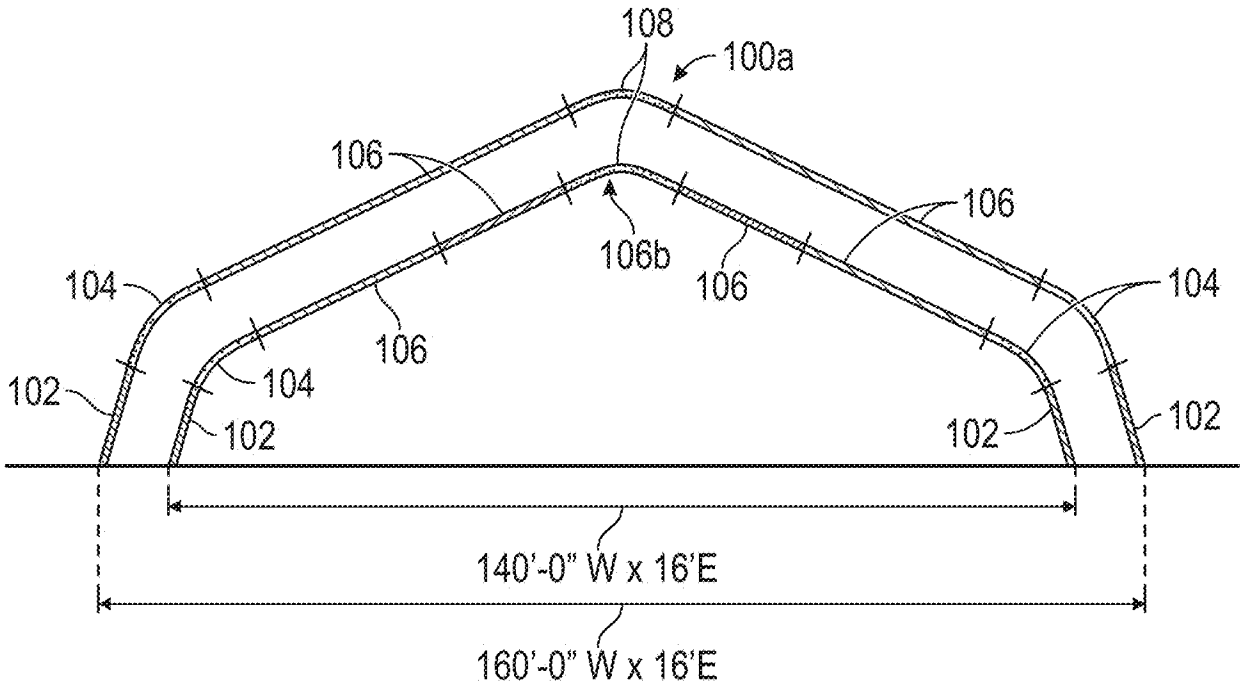
FIG. 5E illustrates two example arches of a semi-permanent relocatable structure constructed from components of an extra-extra-large semi-permanent relocatable structure system according to one embodiment.

FIG. 5E illustrates two example arches of a semi-permanent relocatable structure constructed from components of an extra-extra-large semi-permanent relocatable structure system according to one embodiment. In the illustrated embodiment, the arch 100*a* includes a longer roof straight beam 106 and the arch 100*b* includes two shorter roof straight beams 106. As illustrated, the extra-extra-large system can be configured to provide arches (and structures) with widths of 140 and 160 feet. Further, the arch 100*a* is configured to be 36 feet tall at the eaves and the arch 100*b* is configured to be 16 feet tall at the eaves (in the illustrated embodiment).

In addition to the components described above, in some embodiments, a semi-permanent relocatable structure system can further be configured to be reconfigurable to easily allow the functionality of the semi-permanent relocatable structures constructed therefrom to be adjusted. Different configurations may be possible using several sectional units capable of being integrated to various size structures and added and removed at any time. Different configurations allow the semi-permanent relocatable structure to meet a user's particular needs and transform the semi-permanent relocatable structure to adapt to changes in user needs.

Figure 6:
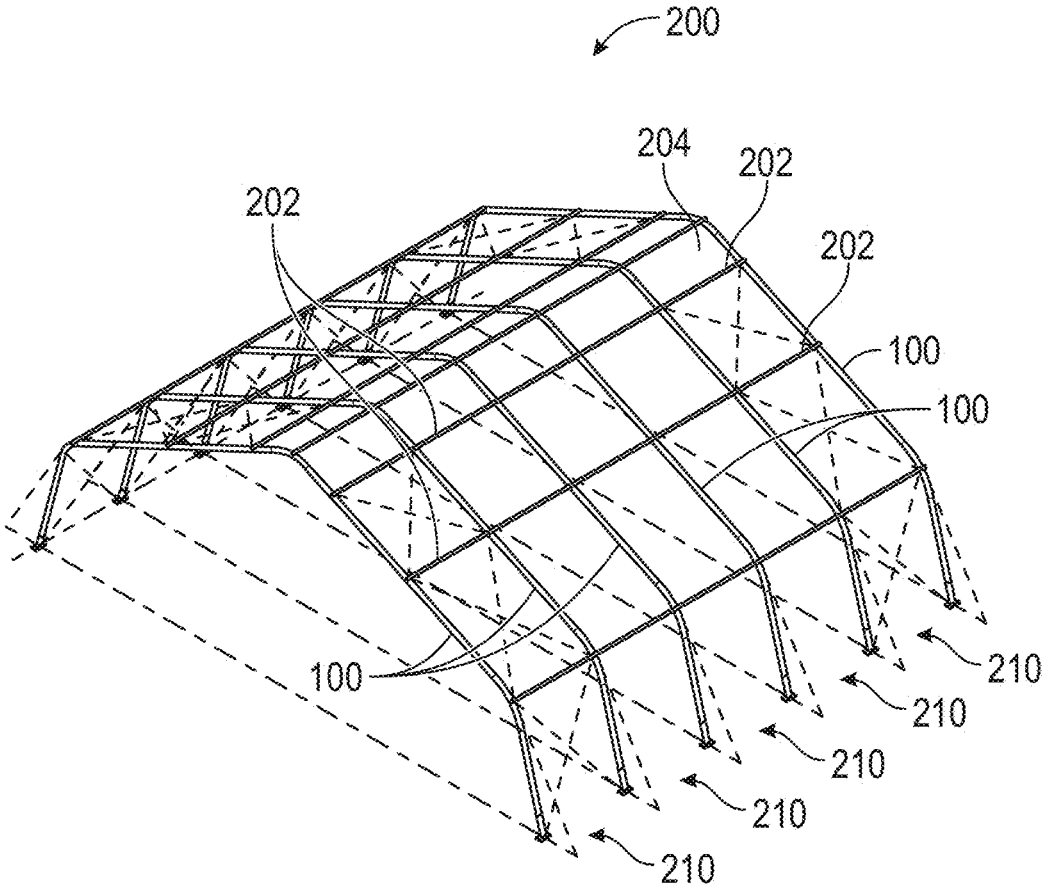
FIG. 6 illustrates an embodiment of a center unit of semi-permanent relocatable structure system according to one embodiment.
Figure 7A:
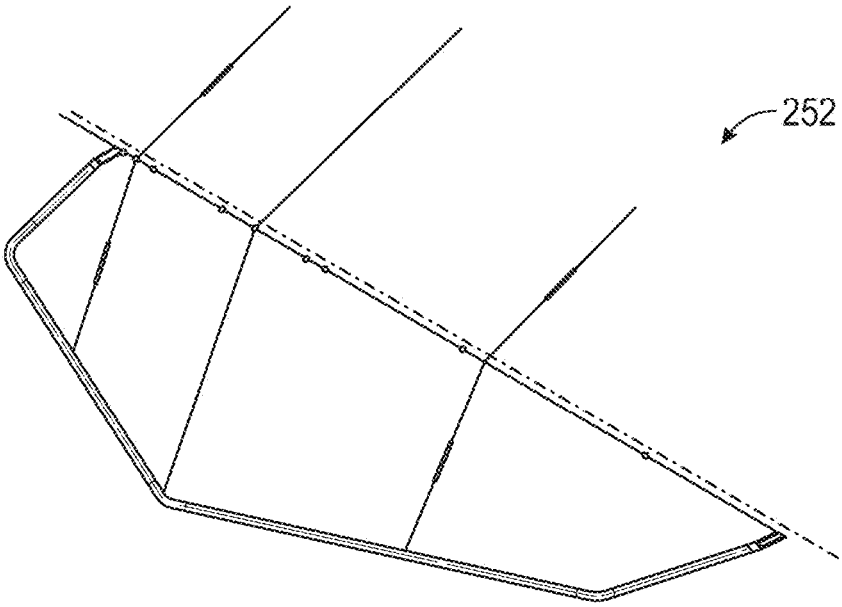
FIGS. 7A-7D illustrate various embodiments of end unit for semi-permanent relocatable structure systems.
Figure 7B:
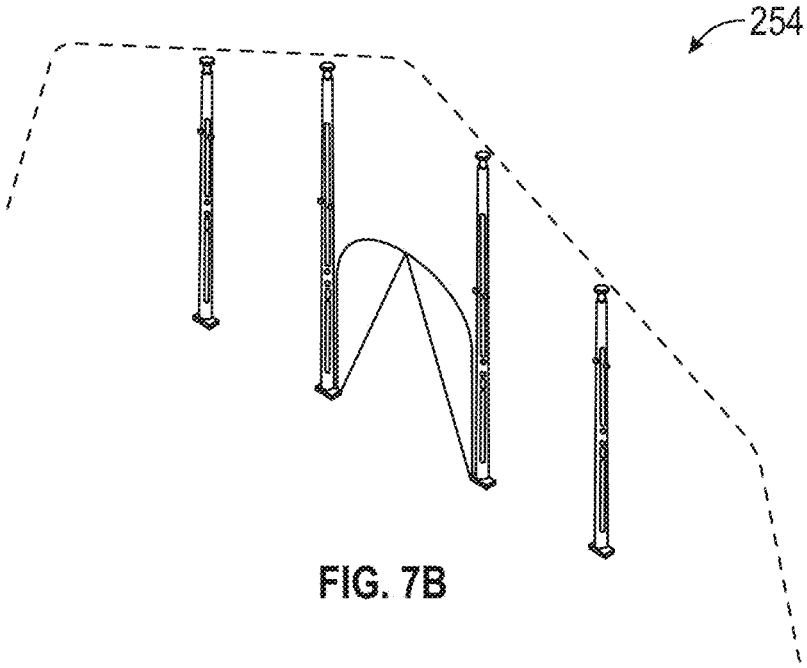
Figure 7C:
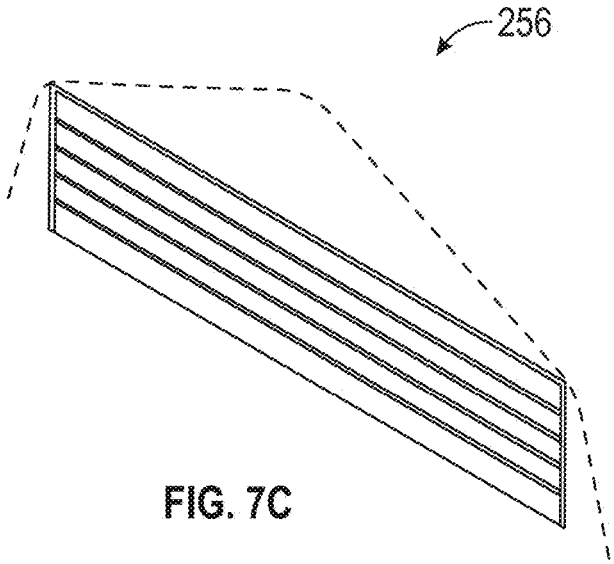
Figure 7D:
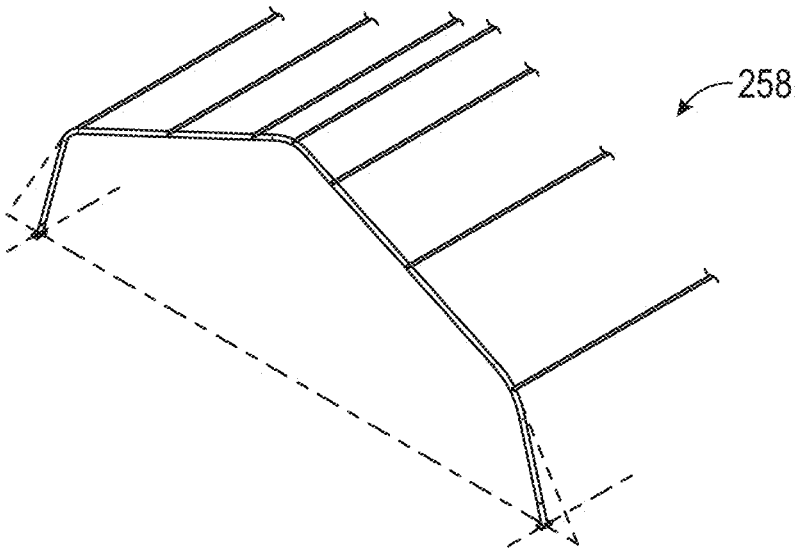

FIGS. 6-7D illustrate various units that can be configured according to the semi-permanent relocatable structure system described herein. FIG. 6 illustrates an example center unit 200. In general, the center unit 200 is used for the main body of the structure. In the illustrated embodiment, the center unit 200 includes a frame. The frame can be made up of arches 100 (which can be made from components as described above). The arches can be connected by purlins 202. The frame can be covered with fabric 204 as shown.

The center unit 200 may comprise a number of sections 210. A section can be a portion of the center unit 200 separated by two adjacent arches 100. In the illustrated embodiment, the center unit 200 comprises five sections 210. Other numbers of sections can be used to increase or decrease the length of the center unit. In some embodiments, the sections are approximately 12 feet long, although other lengths, both longer and shorter are possible. As shown, the ends of the center unit 200 may be open. In some embodiments, a center unit 200 with two open ends may serve as a base unit and can be integrated with any additional unit shown below at any time. A center unit 200 can also be integrated with an additional center unit 200.

FIGS. 7A-7D illustrate various embodiments of end units for semi-permanent relocatable structure systems. The end units 200 may be used to close one or more of the open ends of a center unit 200 (FIG. 6). Other end units 200 (beyond those illustrated in FIGS. 7A-7D are also possible.

FIG. 7A illustrates an example of a full width door unit 252. The full width door unit 252 may be configured to attach to an open end of a center unit 200. The full width door unit 252 may be configured to be open such that access to the open end of the center unit 200 is possible. In some embodiments, the full width door unit 252 can include an electric or manual winch for opening and closing the unit 252.

FIG. 7B illustrates an example of a gable end unit 254. The gable end unit 254 may be configured to attach to an open end of a center unit 200. The gable end unit 254 can comprise a wall. The gable end unit 254 can comprise a door. In some embodiments, the door can be a fabric sliding door.

FIG. 7C illustrates an example of a fabric vertical door unit 256. The fabric vertical door unit 256 may be configured to attach to an open end of a center unit 200. The fabric vertical door unit 256 may comprise a vertical door that can be opened and closed to allow access to the interior of the structure.

FIG. 7D illustrates a bay end unit 258. The bay end unit 254 may be configured to allow an end of the center unit 200 to remain open. In some embodiments, the bay end unit 254 is configured to allow the open end of the center unit to be connected to an open end of an adjacent center unit to increase the overall length of the structure.

Figures 8A, 8B, 8C:
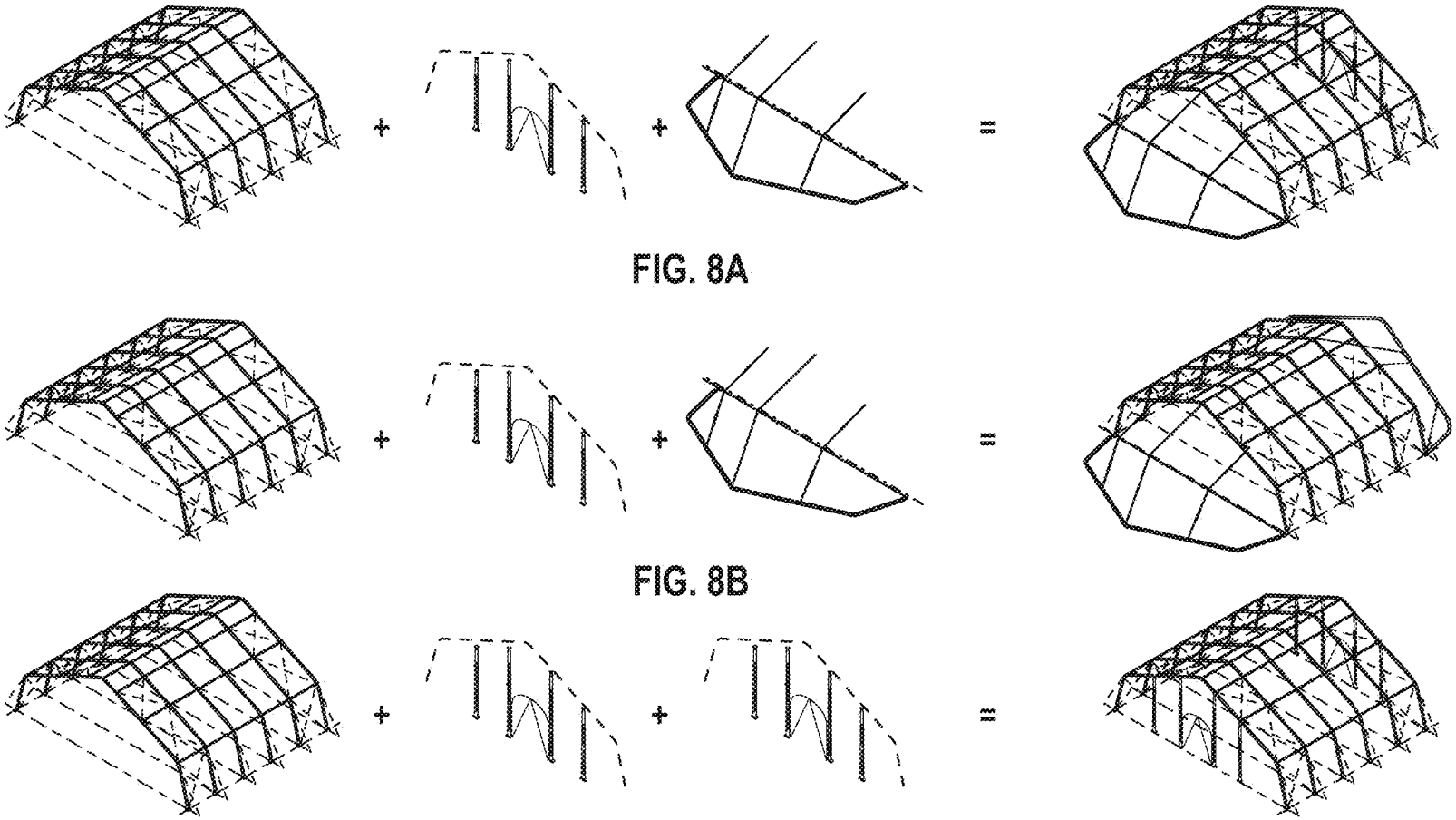
FIGS. 8A-8E illustrate various configurations for a semi-permanent relocatable structure using the different units illustrated in FIGS. 7A-7D.
Figure 8D:
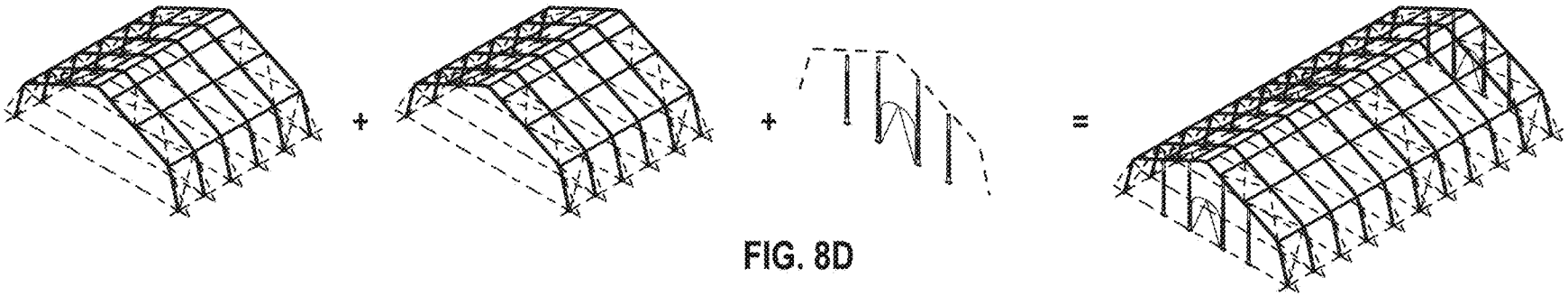
Figure 8E:
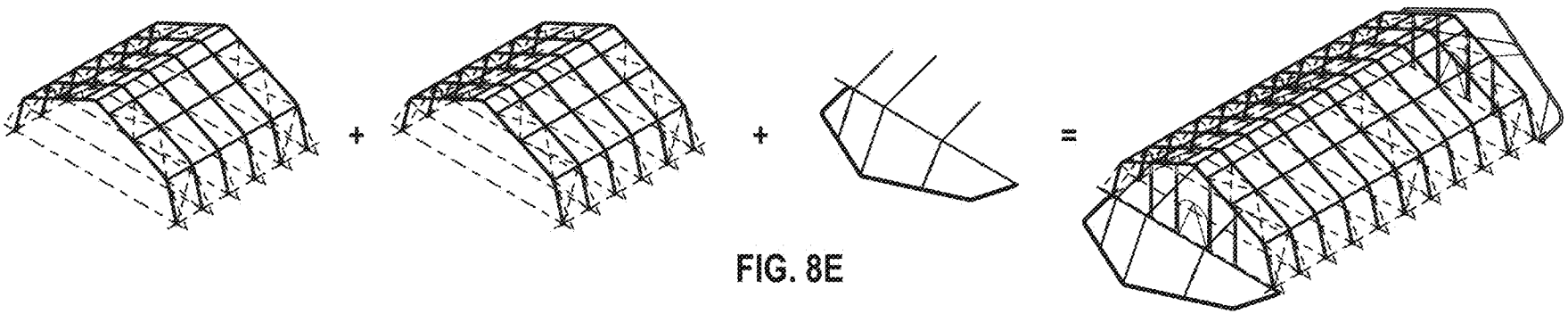

FIGS. 8A-8E illustrate various configurations for a semi-permanent relocatable structure using the different units illustrated in FIG. 6 and FIGS. 7A-7D. As shown in FIG. 8A, a structure can be constructed that comprises a center unit 200, a gable end unit 254, and a full width door unit 252. As shown in FIG. 8B, a structure can be constructed that comprises a center unit 200 and two full width door units 252. As shown in FIG. 8C, a structure can be constructed that comprises a center unit 200 and two gable end units 254. As shown in FIG. 8D, a structure can be constructed that comprises two center units 200 and two gable end units 254. As shown in FIG. 8E, a structure can be constructed that comprises two center units 200 and two full width door units 252.

The structures provided in FIGS. 8A-8E are only a few examples of the types of structures that can be constructed with the semi-permanent relocatable structure system described herein. Further, it will be appreciated that the widths of the structures can be varied by using the parts described above.

The configurations described herein can allow for efficient transition between applications with no additional design or engineering costs. In some embodiments, a structure built with this system can begin as, or transition to, standard LAMS (aviation, vehicle, or storage) units over time as mission necessities evolve or missions extend.

Due to the unique design, the system described herein is the ideal product for BARE Base buildup. The system was innovated from experience in the field and is adaptable to mission timelines allowing end users to begin with the basics and add to or modify configurations as necessary over time. Center units 200 can serve as first phase units and can be expanded or modified through their parts and unit configurations and kits depending on the mission.

The versatile design of the system allows for quick, safe installation for temporary and rapid deployment, as well as, adaptation for mission expansion and long term sustainability. Units can easily transition through various levels of field operations for multiple uses over time, therefore maximizing operational possibilities.

In some embodiments, the system can further includes one or more accessories. These accessories can be integrated into a structure constructed with the system at any time and modified as needed. In some embodiments, these accessories include: personnel doors, vehicle entrance doors, aircraft—full width doors, large vertical doors, ventilation and HVAC systems, tool kits, insulating liners (e.g., with R6 to R16 insulation values), plug-and-play electrical kit/power distribution, relocatable flooring in place of concrete slab (e.g., 80,000 psf flooring), plug-and-play solar power systems for energy efficiency, and full width door/lights operation.

Further, the systems can be designed for efficient packing techniques. For example, the systems can be configured with compact weight and cube volumes. In some embodiments, the systems can be configured to ship and store in standard 20 foot ISO containers (8 foot width×20 foot length×8 foot 6 inches height) allowing for ease in air lifting to remote locations and more efficient sea cargo.

In some embodiments, the system is designed for constant winds of 90 mph with a utility load of 8 pounds per square foot (psf) per the International Building Code (IBC 2012). In some embodiments, the system is designed to withstand wind loading to 115 mph and 20 psf ground snow.

In some embodiments, the system may include integrated weather barriers, such as, arch covers a relocatable perimeter weather seal (RPAWS), which can be integrated water management features.

In some embodiments, the frames (e.g., arches or beams) have a hollow oval-arch design made from extruded corrosion-resistant, anodized, lightweight 6061-T6 structural grade aluminum. Other materials can also be used.

In some embodiments, the structure consists of a series of identical arches with connecting purlins and cables. The arches (formed of one or more beams) have rounded eaves and apex with snap button connections. The extrusion for the arches has integral inner and outer channels to accommodate exterior (fabric shell) and interior (liner) tensioned fabric panels. Purlins and shear cables are located on the inside of the fabric shell. Articulating purlins provide additional tensioning and keep fabric taught.

In some embodiments, the fabric is made of high-strength, tear resistant, coated, PVC synthetic scrim material of at least 22 ounces per square yard. Other types of fabric materials may also be used.

In some embodiments, structures made with the system can be fully relocatable, allowing for disassembly and reuse of all components (except, in some embodiments, concrete anchors if present) without additional fabrication or welding of structural components or fabric. Arch assemblies snap together on the ground and are tilted up to position after attachment to base plates utilizing a hinge-pin design. Purlins are also attached prior to lifting arch and are set from ground. The snap button connections allow for easy, safe installation without nuts and bolts which can be easily be lost during disassembly and relocation.

The system may provide one or more of the following advantages: ability to modify width and length of the structure; different configurations allowing units to transition between applications over time; seamless transition from temporary to permanent; integrated accessories easily configured into layout at any time. Additionally, the system may provide for one or more of the following: a simplified inventory; reduced load volume for storage and shipment worldwide; compact weight and cube; plug-and-play power distribution; connection to solar power systems; and zero footprint. Moreover, in some embodiments, the system includes one or more of the following features: lightweight and durable aluminum arches that are rust resistant; high quality PVC coated fabric—for extreme heat or cold; articulating purlins for taught fabric—tensioning process; highly resistant to the elements (e.g., certified engineering for wind and snow—IBC 2012). In addition, the system may: be ground erectable for safe and quick installation; include pre-assembled components and minimal parts; require no onsite welding, and use snap button connections instead of nuts or bolts; require no foundation, and can be installed on, grass, dirt, asphalt or concrete.

While the above detailed description has shown, described, and pointed out novel and nonobvious features of the inventions described herein as applied to various embodiments, it will be understood that various omissions, substitutions, and changes in the form and details of the device or process illustrated can be made by those skilled in the art without departing from the spirit of the inventions. As will be recognized, the present inventions can be embodied within a form that does not provide all of the features and benefits set forth herein, as some features can be used or practiced separately from others. The scope of the inventions are indicated by the appended claims rather than by the foregoing description. All changes which come within the meaning and range of equivalency of the claims are to be embraced within their scope.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the inventions should not be taken to imply that the terminology is being re-defined herein to be restricted to including any specific characteristics of the features or aspects of the technology with which that terminology is associated.

It will be appreciated by those skilled in the art that various modifications and changes can be made without departing from the scope of the described technology. Such modifications and changes are intended to fall within the scope of the embodiments. It will also be appreciated by those of skill in the art that parts included in one embodiment are useable with other embodiments; one or more parts from a depicted embodiment can be included with other depicted embodiments in any combination. For example, any of the various components described herein and/or depicted in the Figures can be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations can be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims can contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

The above description discloses several methods and materials of the present inventions. These inventions are susceptible to modifications in the methods and materials, as well as alterations in the fabrication methods and equipment. Such modifications will become apparent to those skilled in the art from a consideration of this disclosure or practice of the inventions disclosed herein. Consequently, it is not intended that these inventions be limited to the specific embodiments disclosed herein, but that it cover all modifications and alternatives coming within the true scope and spirit of the inventions as embodied in the attached claims.

What is claimed is:

1. A method for reconfiguring a semi-permanent relocatable structure, wherein the semi-permanent relocatable structure comprises at least a center section comprising a frame including a plurality of arches connected by purlins and covered with fabric and having a first open end and a second open end, wherein each of the plurality of arches comprises at least a pair of leg beams, a pair of eave beams, a plurality of straight roof beams, and an apex beam, the method comprising:

assembling the semi-permanent relocatable structure in a first configuration by, for each arch of the plurality of arches of the center section:

selecting a first pair of straight roof beams from among a plurality of straight roof beams, wherein each of the selected first pair of straight roof beams comprises a first length; and assembling the arch by connecting the pair of leg beams, the pair of eave beams, the selected first pair of straight roof beams, and the apex beam such that the arch comprises a first width measured between lower ends of the pair of leg beams;

reconfiguring the semi-permanent relocatable structure such that each of the plurality of arches of the center section comprises a second width different than the first width such that an overall width of the semi-permanent relocatable structure in the second configuration is different than an overall width of the semi-permanent relocatable structure in the first configuration by, for each of the plurality of arches of the center section:

selecting a second pair of straight roof beams from among the plurality of straight roof beams, wherein each of the selected second pair of straight roof beams comprises a second length different than the first length;

removing the selected first pair of straight roof beams; and replacing the removed first pair of straight roof beams with the selected second pair of straight roof beams so that the arch comprises the second width; and connecting, to the first open end of the semi-permanent relocatable structure in the second configuration, at least one of: a full width door unit, a gable end unit, a fabric vertical door unit, and an open end of an additional center section.

2. The method of claim 1, further comprising removing and replacing the at least one full width door unit, gable end unit, fabric vertical door unit, and additional center section connected to the first end with at least one other full width door unit, gable end unit, fabric vertical door unit, or additional center section.

3. The method of claim 1, further comprising connecting, to the second open end, at least one of: a full width door unit, a gable end unit, a fabric vertical door unit, and an open end of an additional center section.

4. The method of claim 1, further comprising attaching at least one ventilation or HVAC system, insulating liner, power distribution system, relocatable flooring system, or solar power system to the semi-permanent relocatable structure.

5. The method of claim 1, further comprising adding additional center sections to adjust a length of the semi-permanent relocatable structure.

* * * * *